US008127398B2

(12) United States Patent
Conrad

(10) Patent No.: US 8,127,398 B2
(45) Date of Patent: Mar. 6, 2012

(54) CONVERTIBLE SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 1119 days.

(21) Appl. No.: 11/954,078

(22) Filed: Dec. 11, 2007

(65) Prior Publication Data

US 2008/0209666 A1 Sep. 4, 2008

Related U.S. Application Data

(60) Provisional application No. 60/869,586, filed on Dec. 12, 2006.

(51) Int. Cl.
*A47L 5/00* (2006.01)
*A47L 9/00* (2006.01)

(52) U.S. Cl. ..... 15/327.5; 15/331; 15/334; 15/335; 15/351; 15/352; 15/353

(58) Field of Classification Search ..... 15/327.5, 15/331, 334, 335, 351–353; *A47I 5/00, 9/00*
See application file for complete search history.

(56) References Cited

U.S. PATENT DOCUMENTS

| | | | |
|---|---|---|---|
| 2,210,950 | A | 8/1940 | Replogle |
| 4,373,228 | A | 2/1983 | Dyson |
| 4,393,536 | A | 7/1983 | Tapp |
| 5,054,157 | A | 10/1991 | Werner et al. |
| 5,309,600 | A | 5/1994 | Weaver et al. |
| 5,477,586 | A | 12/1995 | Jacobs et al. |
| 5,524,321 | A | 6/1996 | Weaver et al. |
| 5,836,047 | A | 11/1998 | Lee et al. |
| 6,058,559 | A | 5/2000 | Yoshimi et al. |
| 6,094,775 | A | 8/2000 | Behmer |
| 6,122,796 | A | 9/2000 | Downham et al. |

(Continued)

FOREIGN PATENT DOCUMENTS

CA 2551200 A1 2/2004

(Continued)

OTHER PUBLICATIONS

Supplementary Search Report received on the corresponding European Patent Application No. 07855490.4, mailed on May 26, 2010.

(Continued)

*Primary Examiner* — David Redding
(74) *Attorney, Agent, or Firm* — Bereskin & Parr LLP S.E.N.C.R.L., s.r.l.; Philip C. Mendes da Costa

(57) ABSTRACT

An upright surface cleaning apparatus is disclosed. Embodiments of the apparatus comprise a surface cleaning head having a dirty fluid inlet. A fluid flow path extends from the dirty fluid inlet to a clean air outlet, and includes a suction motor and at least one cleaning stage. An upright section is mounted to the surface cleaning head and comprises at least one cleaning stage having an inlet. An above floor cleaning wand is connectable to the fluid flow path and has an inlet end. A valve is operable between a first position in which the surface cleaning head is in fluid flow communication with the at least one cleaning stage and a second position in which the above floor cleaning wand is in fluid flow communication with the at least one cleaning stage. In some embodiments, the valve is positioned adjacent the inlet of the at least one cleaning stage.

37 Claims, 5 Drawing Sheets

U.S. PATENT DOCUMENTS

| | | | | |
|---|---|---|---|---|
| 6,243,916 | B1 | 6/2001 | Embree et al. | |
| 6,295,692 | B1 | 10/2001 | Shideler | |
| 6,311,366 | B1 * | 11/2001 | Sepke et al. | 15/412 |
| 6,317,920 | B1 | 11/2001 | Brickner et al. | |
| 6,317,921 | B1 * | 11/2001 | Park et al. | 15/334 |
| 6,374,453 | B1 | 4/2002 | Kim | |
| 6,497,001 | B2 | 12/2002 | Di Nunzio et al. | |
| 6,532,621 | B2 | 3/2003 | Stephens et al. | |
| 6,574,831 | B2 | 6/2003 | Hunter et al. | |
| 6,735,818 | B2 | 5/2004 | Hamada et al. | |
| 6,766,559 | B2 | 7/2004 | Roney et al. | |
| 6,779,229 | B2 | 8/2004 | Lee et al. | |
| 6,782,585 | B1 * | 8/2004 | Conrad et al. | 15/353 |
| 6,807,708 | B2 | 10/2004 | Roney et al. | |
| 6,839,934 | B2 | 1/2005 | Houghton et al. | |
| 6,948,212 | B2 | 9/2005 | Oh et al. | |
| 6,961,975 | B2 | 11/2005 | Park et al. | |
| 7,069,619 | B2 | 7/2006 | Bowden et al. | |
| 7,188,388 | B2 | 3/2007 | Best et al. | |
| 7,350,266 | B2 | 4/2008 | Park et al. | |
| 7,360,274 | B2 | 4/2008 | Park et al. | |
| 7,377,007 | B2 | 5/2008 | Best | |
| 7,377,008 | B2 | 5/2008 | Park et al. | |
| 2003/0159411 | A1 | 8/2003 | Hansen et al. | |

FOREIGN PATENT DOCUMENTS

| | | | |
|---|---|---|---|
| CA | 2423405 | C | 10/2006 |
| CN | 2534954 | Y | 2/2003 |
| EP | 0489468 | A1 | 6/1992 |
| GB | 2325399 | A | 11/1998 |
| GB | 2402048 | A | 12/2004 |
| WO | 2005079648 | A1 | 9/2005 |

OTHER PUBLICATIONS

First Chinese Office Action, dated Jan. 26, 2011, for Application No. 200780051136.3.

* cited by examiner

CONVERTIBLE SURFACE CLEANING APPARATUS

CROSS-REFERENCES TO RELATED APPLICATIONS

This application claims priority from U.S. Provisional Patent application 60/869,586 (filed on Dec. 12, 2006), which is incorporated herein by reference in its entirety.

FIELD OF THE INVENTION

The invention relates to a surface cleaning apparatus having an above floor cleaning mode. More specifically, the invention relates to an upright surface cleaning apparatus that is convertible to a hand or strap carryable surface cleaning apparatus.

BACKGROUND OF THE INVENTION

Upright vacuum cleaners which are convertible from a floor cleaning mode to an above-floor cleaning mode are known. Such vacuum cleaners typically include a valve which is operable to convert the vacuum cleaner from the floor cleaning mode to the above-floor cleaning mode. The valve is typically provided in a surface cleaning head. If the valve is manually operated, then in order to actuate the valve, a user bends down and actuates a control associated with the valve.

SUMMARY OF THE INVENTION

In one broad aspect, an upright surface cleaning apparatus is provided. The apparatus is convertible from a floor cleaning mode to an above-floor cleaning mode. The apparatus comprises a surface cleaning head having a dirty fluid inlet. A fluid flow path extends from the dirty fluid inlet to a clean air outlet of the surface cleaning apparatus, and includes a suction motor and at least one cleaning stage. An upright section is mounted to the surface cleaning head and comprises at least one cleaning stage having an inlet. An above floor cleaning wand is connectable to the fluid flow path and has an inlet end. A valve is operable between a first position in which the surface cleaning head is in fluid flow communication with the at least one cleaning stage and a second position in which the above floor cleaning wand is in fluid flow communication with the at least one cleaning stage. The valve is positioned adjacent the inlet of the at least one cleaning stage.

Embodiments in accordance with this broad aspect may be advantageous because a user may be able to actuate the valve, without bending, crouching, or squatting. Accordingly, the surface cleaning apparatus is relatively easy to convert from a floor cleaning mode to an above-floor cleaning mode. Further, by providing the valve at the inlet of the cleaning stage, preferably a cyclone inlet, the length of the conduit from the dirty air inlet to the cleaning stage inlet, and the number of bends in the conduit, may be reduced. This may decrease the back pressure caused by the flow of fluid through the conduit.

In some embodiments, the suction motor is provided on the upright section. In some embodiments, the suction motor is provided above the inlet of the at least one cleaning stage.

In some embodiments, the suction motor is provided on the upright section and the surface cleaning apparatus has an absence of a down flow duct downstream from the at least one cleaning stage that extends to surface cleaning head. An advantage of this design is that the length of the conduit downstream from the cleaning stage, and the number of bends in the conduit, may be reduced. This may decrease the back pressure caused by the flow of fluid through the conduit.

In some embodiments, the clean air outlet is provided on the upright section.

In some embodiments, the valve is provided in a housing to which the above floor-cleaning wand is secured. In further embodiments, the inlet end of the above floor-cleaning wand is secured to the housing.

In some embodiments, at least one cleaning stage comprises a cyclonic cleaning stage.

In some embodiments, the surface cleaning apparatus comprises an up flow duct mounted to the surface cleaning head and extending externally along the at least one cleaning stage to a position adjacent the inlet of the at least one cleaning stage. In further embodiments, the valve is mounted to the up flow duct.

In some embodiments, the surface cleaning apparatus further comprises a suction and filtration unit comprising the suction motor, the at least one cleaning stage, the above floor cleaning wand and the valve wherein the suction and filtration unit is removable from the surface cleaning apparatus. In further embodiments, the suction and filtration unit further comprises at least one of a carry handle and a shoulder strap.

In another broad aspect, an upright surface cleaning apparatus is provided. The upright surface cleaning apparatus comprises a surface cleaning head having a dirty fluid inlet. A fluid flow path extends from the dirty fluid inlet to a clean air outlet of the surface cleaning apparatus, and includes a suction motor and at least one cleaning stage having an inlet. An upright section is mounted to the surface cleaning head and has a lower portion, a middle portion and an upper portion. An above floor cleaning wand is connectable to the fluid flow path and has an inlet. A valve is operable between a first position in which the surface cleaning head is in fluid flow communication with the at least one cleaning stage, and a second position in which the above floor cleaning wand is in fluid flow communication with the at least one cleaning stage. The valve is positioned above the lower portion of the upright section.

In some embodiments, the at least one cleaning stage is provided on the upright section.

In some embodiments, the suction motor is provided on the upright section. In some embodiments, the suction motor is provided above the inlet of the at least one cleaning stage. In further embodiments, the suction motor is provided on the upright section and the surface cleaning apparatus has an absence of a down flow duct downstream from the at least one cleaning stage that extends to surface cleaning head.

In some embodiments, the clean air outlet is provided on the upright section.

In some embodiments, the valve is provided in a housing to which the above floor-cleaning wand is secured. In further embodiments, the inlet end of the above floor-cleaning wand is secured to the housing.

In some embodiments, the at least one cleaning stage comprises a cyclonic cleaning stage.

In some embodiments, the apparatus further comprises an up flow duct mounted to the surface cleaning head and extending externally along the at least one cleaning stage to a position adjacent the inlet of the at least one cleaning stage. In further embodiments, the valve is mounted to the up flow duct.

In some embodiments, the apparatus further comprises a suction and filtration unit comprising the suction motor, the at least one cleaning stage, the above floor cleaning wand and the valve, wherein the suction and filtration unit is removable from the surface cleaning apparatus. In further embodiments, the suction and filtration unit further comprises at least one of a carry handle and a shoulder strap.

BRIEF DESCRIPTION OF THE DRAWINGS

These and other advantages of the present invention will be more fully and particularly understood in connection with the following description of the preferred embodiments of the invention in which.

DETAILED DESCRIPTION OF THE INVENTION

Figure 1:
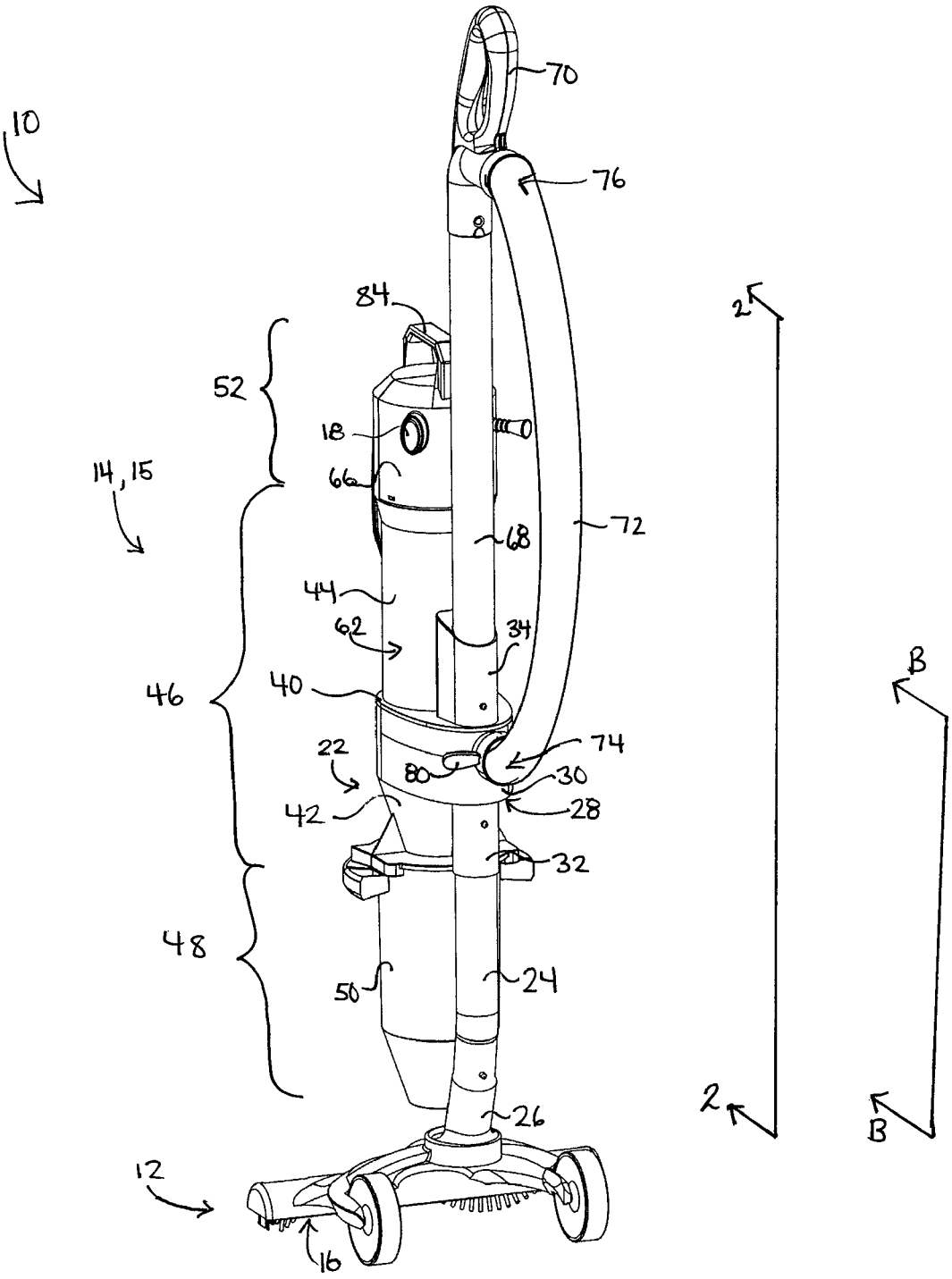
FIG. 1 is a rear perspective view of an embodiment of a surface cleaning apparatus of the present invention in a floor cleaning mode.

Referring to FIG. 1, an embodiment of a surface cleaning apparatus 10 of the present invention is shown. In the embodiment shown, surface cleaning apparatus 10 is an upright vacuum cleaner. In other embodiments, surface cleaning apparatus 10 may be another type of surface cleaning apparatus, for example a carpet extractor, which has an upper portion.

As exemplified, surface cleaning apparatus 10 comprises a surface cleaning head 12 and an upright section 14, comprising a suction and filtration unit 15. A dirty fluid inlet 16 is provided in surface cleaning head 12. A fluid flow path extends from the dirty fluid inlet 16 to a clean air outlet 18. In the embodiments shown, clean air outlet 18 is provided in upright section 14. In alternate embodiments, clean air outlet 18 may be provided on surface cleaning head 12. The fluid flow path comprises a suction motor 20, and at least one cleaning stage 22.

Upright section 14 is pivotally mounted with respect to surface cleaning head. In the exemplified preferred embodiment shown, air enters dirty fluid inlet 16 in surface cleaning head 12, and is directed to an upflow duct 24. Upflow duct 24 is pivotally mounted to surface cleaning head 12 by a pivoting connector 26. Accordingly, as exemplified, upflow duct 24 functions as a support on which upright section 14 is supported. Accordingly a separate casing such as those typically used with upright vacuum cleaners and which are made of molded plastic, is not required. Accordingly, by using upflow duct 24 as the member that supports upright section 14, a lighter weight product may be produced. In such an embodiment, upflow duct may be made from metal, carbon fiber or other high strength materials. In other embodiments, a separate support (not shown) may be provided for supporting upright section 14 and a separate conduit, e.g., a flexible hose, may be used to connect the upright section in fluid flow communication with the surface cleaning head. Alternately, a casing having a spine may be used.

In the embodiment exemplified, housing 28 is preferably provided. Housing 28 functions as a mounting member to which one or more of the operational components (e.g., filter housing, cyclone chamber and/or suction motor) of the surface cleaning apparatus are attached and which is mounted onto the upflow duct 24 or other support member. In this preferred configuration, housing 28 preferably includes air flow passages. If a housing 28 is provided, then housing 28 preferably comprises a passage 38 extending between upflow duct 24 and upright section 14, and provides fluid communication therebetween. As exemplified, housing 28 comprises a body 30, a lower section 32, and an upper section 34.

As exemplified in FIG. 1, body 30 of housing 28 comprises a securing member 40. A cyclone chamber 42 of upright section 14 is positioned below securing member 40, and a filter housing 44 of upright section 14 is positioned above securing member 40. Cyclone chamber 42 and filter housing 44 are then secured to each other, for example by screws, bolts, screw threads, adhesives, a bayonet mount or welding, through an opening extending through housing 28 or separately to housing 28. In alternate embodiments, housing 28 may be integrally formed with an operational component of upright section 14. It will also be appreciated that only one operational component may be secured to housing 28.

In the embodiments shown, upper section 34 of housing 28 removably receives a handle or wand extension 68, which is connected to a handle 70. As will be described further hereinbelow, handle extension 68 is removably mounted in upper section 34, and comprises an inlet 69 that is in fluid communication with upper section 34 via a hose 72, such that handle extension 68 may be converted to an above floor cleaning wand.

Housing 28 is preferably removably mounted to upflow duct 24 or other support member. Any releasable mounting system may be used. As exemplified, lower section 32 is removably connectable to upflow duct 24. For example, in the embodiment shown, lower section 32 comprises an opening 36, into which upflow duct is inserted. Upflow duct 24 may be secured in opening 36, for example by a locking mechanism such as a latch, or by a friction or snap fit or an adhesive or welding. Opening 36 is in fluid communication with cleaning stage 22, via an airflow passage 38 provided in housing 28. Housing 28 may be secured to upflow duct 24 may any other means, such as being mounted to a platform (not shown) secured to upflow duct 24.

In alternate embodiments, housing 28 may not be provided, and upflow duct 24 may be connected directly to upright section 14. In such embodiments, upright section 14 may be mounted directly to upflow duct 24, or a support mount (not shown) may be provided, which removably mounts upright section 14 to upflow duct 24. In further alternate embodiments, wherein a support mount (not shown) is provided in addition to upflow duct 24, upflow duct 24 may be connected directly to upright section 14, or an alternate connector may be provided which connects upflow duct 24 in fluid communication with upright section 14. Furthermore, the support mount may be mounted directly to upright section 14, or a support mount (not shown) may be provided which removably mounts upright section 14 to the support.

It will be appreciated that, in accordance with one aspect of this invention, a section of the vacuum cleaner that is a self contained cleaning and suction unit (i.e., includes one or more cleaning stages and a suction motor) as well as the above floor cleaning wand 68 and valve is removable from the rest of the surface cleaning apparatus. In accordance with another aspect of this invention, a self contained cleaning and suction unit may not be removable.

In the embodiments shown, from airflow passage 38, air is directed into upright section 14. In the embodiments shown, upright section 14 comprises a middle portion 46 adjacent housing 28 preferably comprising cyclonic cleaning stage 22 and filter housing 44, a lower portion 48 below middle portion 46 preferably comprising a dirt bin, and an upper portion 52 above middle portion 46 preferably comprising suction motor 20. In other embodiments, upright section 14 may be otherwise configured. For example, upper portion 52 may comprise cyclonic cleaning stage 22, middle portion 46 may comprise, dirt bin 50, and lower portion 48 may comprise suction motor 20. Alternatively, middle portion 46 may comprise filter housing 44, lower portion 48 may comprise cyclonic cleaning stage 22 and dirt bin 50, and upper portion 52 may comprise an additional cleaning stage (not shown) and suction motor 20. It will be appreciated that upright portion may comprise one or more cleaning stages, one or more of which may be a cyclonic cleaning stage. Each cleaning stage may comprise a single cyclone or a plurality of cyclones in parallel.

Figure 2:
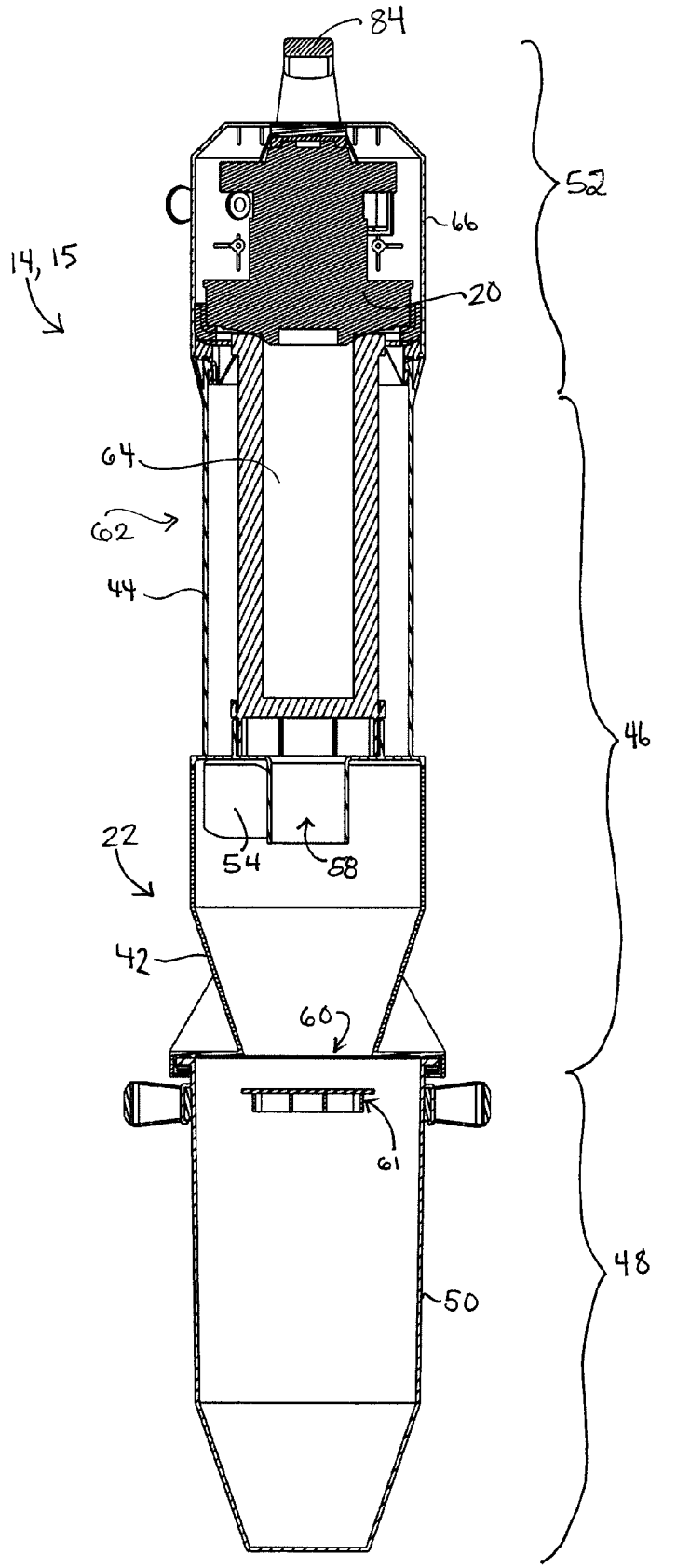
FIG. 2 is a cross section taken along line 2-2 in FIG. 1.

As exemplified in FIG. 2, a cyclonic cleaning stage is used. Accordingly, from airflow passage 38, air may be directed into cyclonic cleaning stage 22. In the preferred embodiment, air enters cyclonic cleaning stage 22 in a tangential motion. Accordingly, airflow passage 38 may extend externally along the outer surface of cleaning stage 22 to a position adjacent the inlet 54 of cyclonic cleaning stage 22, such that air enters inlet 54 tangentially. In an alternate embodiment, wherein housing 28 is not provided, upflow duct 24 may extend externally along the outer surface of cleaning stage 22 to a position adjacent the inlet 54 of cyclonic cleaning stage 22.

In the embodiment shown, the cleaning stage 22 is a cyclonic cleaning stage, comprising a single cyclone chamber 42, having a clean air outlet 58, and a dirt outlet 60. In alternate embodiments, cleaning stage 22 may be otherwise configured. For example, cleaning stage 22 may comprise a plurality of cyclone chambers in parallel.

A dirt chamber 50 is preferably positioned below dirt outlet 60, for collecting material removed from the air in cyclone chamber 24. Preferably, dirt chamber is openable, for example for emptying. In the embodiment shown, dirt chamber 50 is slidably removable from cyclone chamber 42 such that it may be emptied. In alternate embodiments, a bottom of cyclone chamber 42 may be pivotally mounted to cyclone chamber 42, such that it may be emptied or removable therefrom with cyclone chamber 42.

In some embodiments, a divider plate 61 may optionally be associated with dirt outlet 60. Divider plate 61 may be positioned below dirt outlet 60, within dirt chamber 50, as shown in FIG. 2. Alternatively, divider plate may be positioned at dirt outlet 60, or above dirt outlet 50. Divider plate 50 may be of any known configuration and mounted at any known location.

In the embodiment shown, from air outlet 58, air preferably passes into a filter assembly 62. Filter assembly 62 comprises a filter housing 44 housing one or more filter members 64. In the embodiment shown, surface cleaning apparatus comprises only one filter assembly 62. In alternate embodiments, more than one filter assembly may be provided.

In the embodiment shown, from filter assembly 62, air is preferably directed to motor 20, which is housed in motor housing 66. While motor 20 may be provided in upright section 14 or in surface cleaning head 12, it is preferably provided in upright section 14. In embodiments wherein motor 20 is provided in surface cleaning head 12, a downflow duct (not shown) may be provided between upright section 14 and surface cleaning head 12. In embodiments wherein motor 20 is provided in upright section 14, a downflow duct may not be provided.

In the embodiment shown in FIG. 1, surface cleaning apparatus 10 is in a floor-cleaning mode. Surface cleaning apparatus 10 is preferably constructed to be convertible to an above floor cleaning mode, shown in FIG. 3, as will presently be described.

Referring to FIGS. 4A-4B and 5A-5B, a hose 72 is provided, and is in fluid communication with upright section 14 at a first end 74 thereof. A second end 76 of hose 72 is in fluid communication with handle extension 68, which, in the above floor cleaning mode, serves as an above floor cleaning wand.

A valve 78 is provided between hose 72 and upflow duct 24. Valve 78 may be of any known construction. Preferably, as exemplified, valve 78 is rotatable from a first position, shown in FIG. 4B, a second position, shown in FIG. 5B. When valve 78 is in the first position, surface cleaning head 12 is in fluid communication with cleaning stage 22, and fluid communication between hose 72 and cleaning stage 22 is essentially prevented. Accordingly, surface cleaning apparatus may be used in a floor cleaning mode, and air may flow in the direction indicated by arrows $A_1$. When valve 78 is in the second position, hose 72 (and above floor cleaning wand 68) is in fluid communication with cleaning stage 22, and fluid communication between surface cleaning head 12 and valve 78 is essentially prevented. Accordingly surface cleaning apparatus 10 may be used in an above floor cleaning mode, and air may flow in the direction indicated by arrows $A_2$. As can be seen in FIG. 1, a control, for example a lever 80 is provided, for rotating valve 78 between the first position and the second position. In alternate embodiments, the control may be, for example, a button or a switch, and it may be automatically actuated when handle extension 68 is removed from housing 28.

In the exemplified embodiment, valve 78 is provided in airflow passage 38 of housing 28, and is positioned adjacent inlet 54 of cyclonic cleaning stage 22. That is, valve 78 is positioned above lower portion 48 of upright section 14, adjacent middle portion 46. In alternate embodiments, valve 78 may be provided in upflow duct 24. In such embodiments, valve 78 may be positioned adjacent lower portion 48, or adjacent middle portion 46. In other embodiments, valve 78 may be provided in hose 72, or in handle extension 68. In such embodiments, valve 78 may be positioned adjacent middle portion 46, or adjacent upper portion 52.

Such embodiments, wherein valve 78 is adjacent or above lower portion 48, may be advantageous because a user may be able to convert surface cleaning apparatus 10 from a floor cleaning mode to an above-floor cleaning mode without having to bend or squat to actuate control 80.

Figure 3:
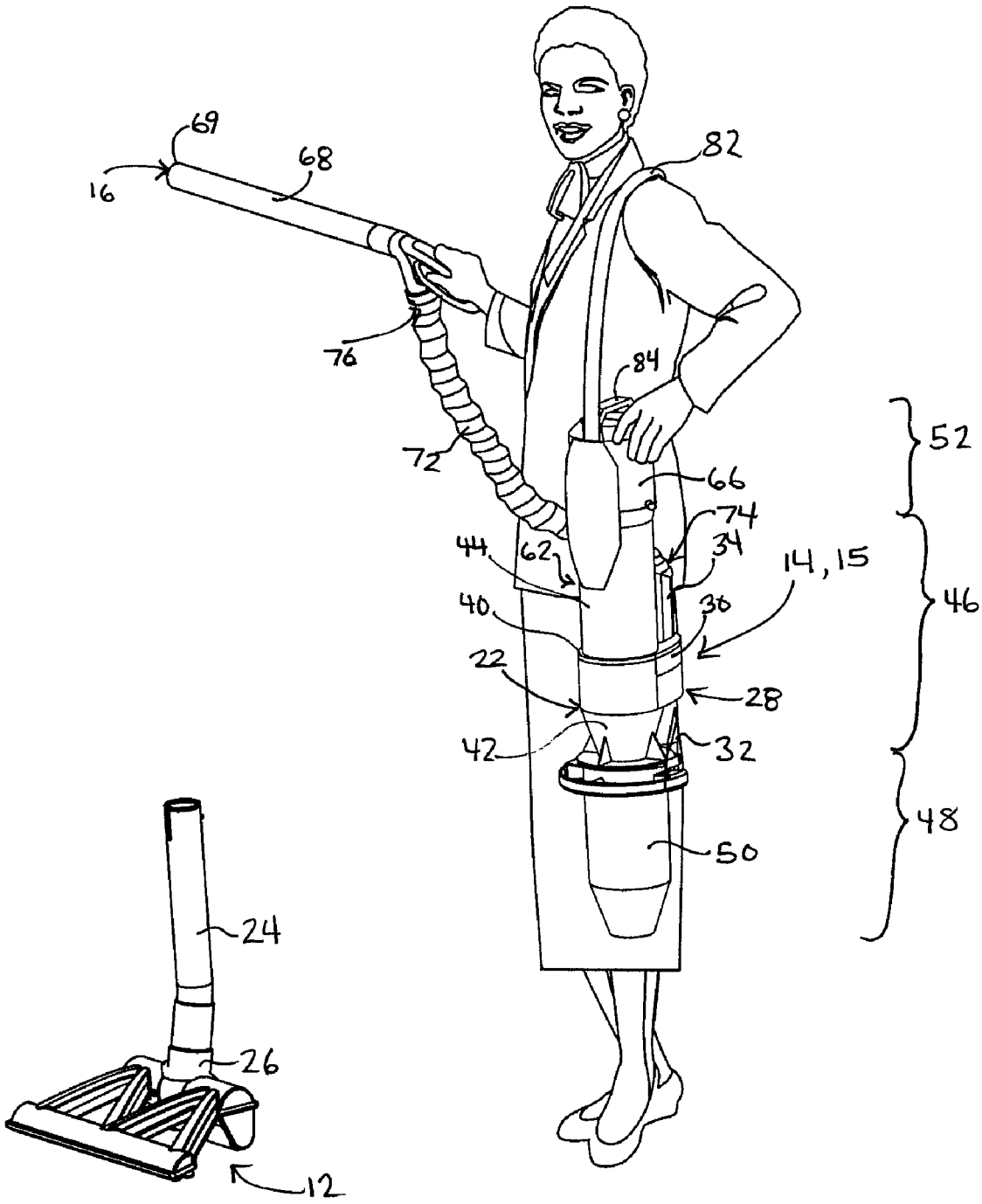
FIG. 3 is a perspective view of the surface cleaning apparatus of FIG. 1 in an above-floor cleaning mode.
Figure 4B:
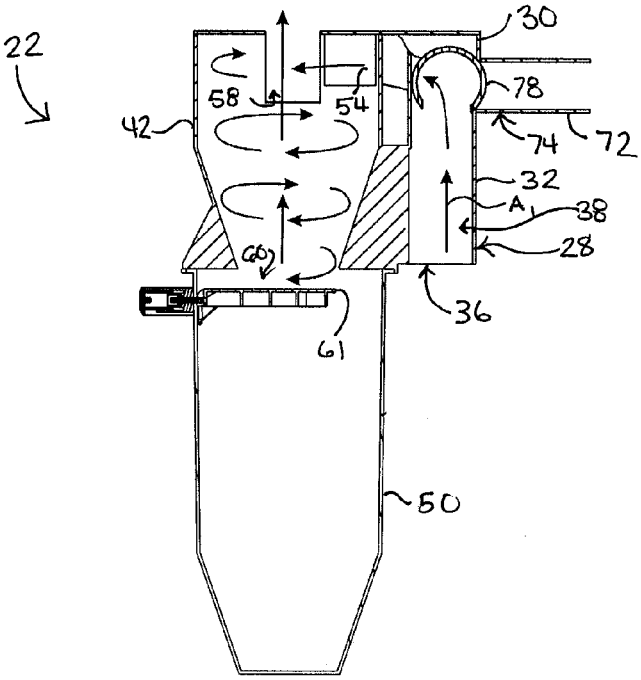
FIG. 4B is a cross section taken along line B-B in FIG. 1.
Figure 4A:
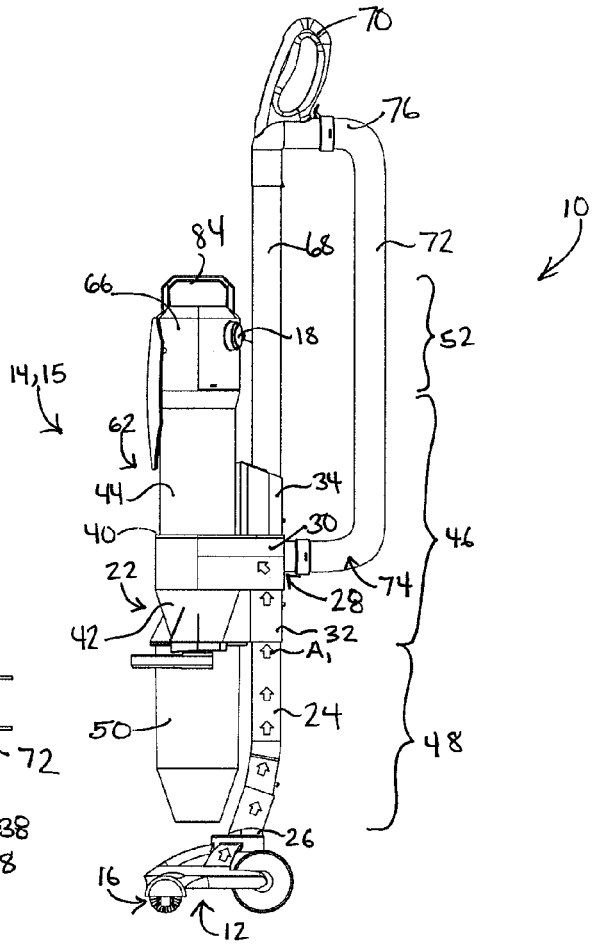
FIG. 4A is a side view of the surface cleaning apparatus of FIG. 1, showing a direction of air flow.
Figure 5A:
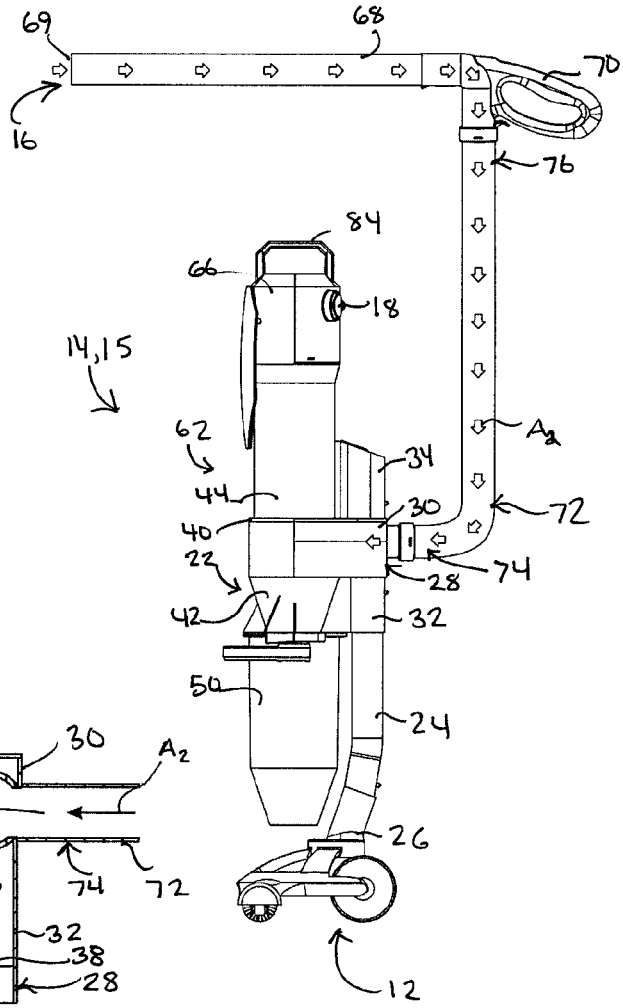
FIG. 5A is a side view of the surface cleaning apparatus of FIG. 1 in an above-floor cleaning mode, showing a direction of airflow; and, FIG. 5B is a cross section taken along line B-B in FIG. 1.
Figure 5B:
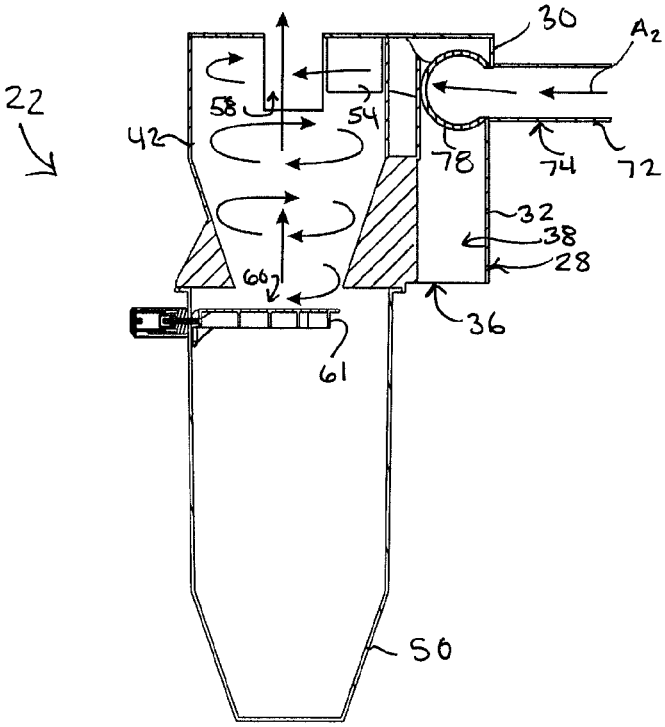

In further embodiments, when surface cleaning apparatus is in the above-floor cleaning mode, surface cleaning apparatus may be converted to a hand or strap carryable surface cleaning apparatus. Referring to FIG. 3, as previously mentioned, upright section 14, including suction and suction unit 15, may be removably mounted to surface cleaning head 12. For example, in the embodiments shown, upflow duct 24 is inserted into opening 36 of housing 28, and secured therein by a friction fit. Accordingly, a user may lift upright section 14 off of upflow duct 24, and may carry suction and suction unit 15 using a strap 82 or a handle 84 provided on upright section 14.

It will be appreciated that the positioning of valve 78 may be used in embodiments wherein upright section 14, or a self contained cleaning and suction unit 15 is not removable from the surface cleaning apparatus. In such cases, surface cleaning apparatus preferably uses an upflow duct 24 as a mount for the upright section 14. In addition, each of the optional features set out herein may be used in such an embodiment.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

The invention claimed is:

1. An upright surface cleaning apparatus comprising:

(a) a surface cleaning head having a dirty fluid inlet;

(b) a fluid flow path extending from the dirty fluid inlet to a clean air outlet of the surface cleaning apparatus and including a suction motor and at least one cleaning stage;

(c) an upright section mounted to the surface cleaning head;

(d) a suction and filtration unit comprising the suction motor and at least one cleaning stage, wherein the suction and filtration unit is removable from the surface cleaning head;

(e) an above floor cleaning wand connectable to the fluid flow path and having an inlet end;

(f) a valve operable between a first position in which the surface cleaning head is in fluid flow communication with the at least one cleaning stage and a second position in which the above floor cleaning wand is in fluid flow communication with the at least one cleaning stage wherein the valve is positioned adjacent the inlet of the at least one cleaning stage and the valve is provided in a housing to which the above floor-cleaning wand is secured and the inlet end of the above floor-cleaning wand is secured to the housing; and, (g) a further fluid flow path extending between the above floor cleaning wand and the at least one cleaning stage and the further fluid flow path comprises a hose extending between the above floor cleaning wand and the housing.

2. The upright surface cleaning apparatus of claim 1 wherein the suction motor is provided above the inlet of the at least one cleaning stage.

3. The upright surface cleaning apparatus of claim 1 wherein the surface cleaning apparatus has an absence of a down flow duct downstream from the at least one cleaning stage that extends to surface cleaning head.

4. The upright surface cleaning apparatus of claim 1 wherein the clean air outlet is provided on the upright section.

5. The upright surface cleaning apparatus of claim 1 wherein the inlet end of the above floor-cleaning wand is secured to the housing.

6. The upright surface cleaning apparatus of claim 1 wherein the at least one cleaning stage comprises a cyclonic cleaning stage.

7. The upright surface cleaning apparatus of claim 1 further comprising an up flow duct mounted to the surface cleaning head and extending externally along the at least one cleaning stage to a position adjacent the inlet of the at least one cleaning stage.

8. The upright surface cleaning apparatus of claim 7 wherein the valve is mounted to the up flow duct.

9. The upright surface cleaning apparatus of claim 1 wherein the suction and filtration unit further comprises the above floor cleaning wand and the valve.

10. The upright surface cleaning apparatus of claim 1 wherein the suction and filtration unit further comprises at least one of a carry handle and a shoulder strap.

11. An upright surface cleaning apparatus comprising:

(a) a surface cleaning head having a dirty fluid inlet;

(b) a fluid flow path extending from the dirty fluid inlet to a clean air outlet of the surface cleaning apparatus and including a suction motor and at least one cleaning stage having an inlet;

(c) an upright section mounted to the surface cleaning head and having a lower portion, a middle portion and an upper portion;

(d) an above floor cleaning wand connectable to the fluid flow path and having an inlet;

(e) a valve operable between a first position in which the surface cleaning head is in fluid flow communication with the at least one cleaning stage and a second position in which the above floor cleaning wand is in fluid flow communication with the at least one cleaning stage wherein the valve is positioned above the lower portion of the upright section and is provided in a housing to which the above floor-cleaning wand is secured and the inlet end of the above floor-cleaning wand is mounted to the housing; and, (f) a handle drivingly connected to the above floor cleaning wand and the above floor cleaning wand is drivingly connected to a support member extending upwardly from the surface cleaning head.

12. The upright surface cleaning apparatus of claim 11 wherein the at least one cleaning stage is provided on the upright section.

13. The upright surface cleaning apparatus of claim 11 wherein the suction motor is provided on the upright section.

14. The upright surface cleaning apparatus of claim 11 wherein the suction motor is provided above the inlet of the at least one cleaning stage.

15. The upright surface cleaning apparatus of claim 11 wherein the suction motor is provided on the upright section and the surface cleaning apparatus has an absence of a down flow duct downstream from the at least one cleaning stage that extends to surface cleaning head.

16. The upright surface cleaning apparatus of claim 11 wherein the clean air outlet is provided on the upright section.

17. The upright surface cleaning apparatus of claim 11 wherein the at least one cleaning stage comprises a cyclonic cleaning stage.

18. The upright surface cleaning apparatus of claim 11 wherein the support member comprises up flow duct mounted to the surface cleaning head and extending externally along the at least one cleaning stage to a position adjacent the inlet of the at least one cleaning stage.

19. The upright surface cleaning apparatus of claim 18 wherein the valve is mounted to the up flow duct.

20. The upright surface cleaning apparatus of claim 11 further comprising a suction and filtration unit comprising the suction motor, the at least one cleaning stage, the above floor cleaning wand and the valve wherein the suction and filtration unit is removable from the surface cleaning apparatus.

21. The upright surface cleaning apparatus of claim 1 further comprising a handle driving connected to the above floor cleaning wand and the above floor cleaning wand is driving connected to a support member extending upwardly from the surface cleaning head.

22. The upright surface cleaning apparatus of claim 1 further comprising a handle driving connected to the above floor cleaning wand.

23. An upright surface cleaning apparatus comprising:

a) a surface cleaning head having a dirty fluid inlet;

b) a fluid flow path extending from the dirty fluid inlet to a clean air outlet of the surface cleaning apparatus and including a suction motor and at least one cleaning stage;

c) an upright section mounted to the surface cleaning head and comprising at least one cleaning stage having an inlet;

d) an above floor cleaning wand connectable to the fluid flow path and having an inlet end;

e) a valve operable between a first position in which the surface cleaning head is in fluid flow communication with the at least one cleaning stage and a second position in which the above floor cleaning wand is in fluid flow communication with the at least one cleaning stage wherein the valve is positioned adjacent the inlet of the at least one cleaning stage and wherein the valve is provided in a housing to which the inlet end of the above floor-cleaning wand is removably secured; and, f) a handle driving connected to the above floor cleaning wand and a further fluid flow path extending between the above floor cleaning wand and the at least one cleaning stage and the further fluid flow path comprises a hose.

24. The upright surface cleaning apparatus of claim 23 further comprising a suction and filtration unit comprising the suction motor and the at least one cleaning stage, wherein the suction and filtration unit is removable from the surface cleaning apparatus.

25. An upright surface cleaning apparatus comprising:

a) a surface cleaning head having a dirty fluid inlet;

b) a fluid flow path extending from the dirty fluid inlet to a clean air outlet of the surface cleaning apparatus and including a suction motor and at least one cleaning stage;

c) an upright section mounted to the surface cleaning head and comprising at least one cleaning stage having an inlet;

d) an above floor cleaning wand connectable to the fluid flow path and having an inlet end;

e) a further fluid flow path extending between the above floor cleaning wand and the at least one cleaning stage and the further fluid flow path comprises a hose;

f) a valve operable between a first position in which the surface cleaning head is in fluid flow communication with the at least one cleaning stage and a second position in which the above floor cleaning wand is in fluid flow communication with the at least one cleaning stage wherein the valve is positioned adjacent the inlet of the at least one cleaning stage, wherein the valve is provided in a housing to which the inlet end of the above floor-cleaning wand is drivingly removably secured.

26. The upright surface cleaning apparatus of claim 25 further comprising a suction and filtration unit comprising the suction motor and the at least one cleaning stage, wherein the suction and filtration unit is removable from the surface cleaning apparatus.

27. An upright surface cleaning apparatus comprising:

(a) a surface cleaning head having a dirty fluid inlet;

(b) a fluid flow path extending from the dirty fluid inlet to a clean air outlet of the surface cleaning apparatus and including a suction motor and at least one cleaning stage having an inlet, the at least one cleaning stage comprising a cyclonic cleaning stage;

(c) an upright section mounted to the surface cleaning head and having a lower portion, a middle portion and an upper portion;

(d) an above floor cleaning wand connectable to the fluid flow path and having an inlet;

(e) a valve operable between a first position in which the surface cleaning head is in fluid flow communication with the at least one cleaning stage and a second position in which the above floor cleaning wand is in fluid flow communication with the at least one cleaning stage wherein the valve is positioned above the lower portion of the upright section; and, (f) a handle drivingly connected to the above floor cleaning wand and the above floor cleaning wand is drivingly connected to a support member extending upwardly from the surface cleaning head.

28. An upright surface cleaning apparatus comprising:

(a) a surface cleaning head having a dirty fluid inlet;

(b) a fluid flow path extending from the dirty fluid inlet to a clean air outlet of the surface cleaning apparatus and including a suction motor and at least one cleaning stage having an inlet;

(c) an upright section mounted to the surface cleaning head and having a lower portion, a middle portion and an upper portion;

(d) an above floor cleaning wand connectable to the fluid flow path and having an inlet;

(e) a valve operable between a first position in which the surface cleaning head is in fluid flow communication with the at least one cleaning stage and a second position in which the above floor cleaning wand is in fluid flow communication with the at least one cleaning stage wherein the valve is positioned above the lower portion of the upright section; and, (f) a handle drivingly connected to the above floor cleaning wand and the above floor cleaning wand is drivingly connected to a support member extending upwardly from the surface cleaning head wherein the support member comprises an up flow duct mounted to the surface cleaning head and extending externally along the at least one cleaning stage to a position adjacent the inlet of the at least one cleaning stage.

29. The upright surface cleaning apparatus of claim 28 wherein the valve is mounted to the up flow duct.

30. The upright surface cleaning apparatus of claim 28 wherein the suction motor is provided on the upright section and the surface cleaning apparatus has an absence of a down flow duct downstream from the at least one cleaning stage that extends to surface cleaning head.

31. The upright surface cleaning apparatus of claim 28 further comprising a suction and filtration unit comprising the suction motor, the at least one cleaning stage, the above floor cleaning wand and the valve wherein the suction and filtration unit is removable from the surface cleaning apparatus.

32. An upright surface cleaning apparatus comprising:

(a) a surface cleaning head having a dirty fluid inlet;

(b) a fluid flow path extending from the dirty fluid inlet to a clean air outlet of the surface cleaning apparatus and including a suction motor and at least one cleaning stage having an inlet;

(c) an upright section mounted to the surface cleaning head and having a lower portion, a middle portion and an upper portion;

(d) an above floor cleaning wand connectable to the fluid flow path and having an inlet;

(e) a valve operable between a first position in which the surface cleaning head is in fluid flow communication with the at least one cleaning stage and a second position in which the above floor cleaning wand is in fluid flow communication with the at least one cleaning stage wherein the valve is positioned above the lower portion of the upright section;

(f) a handle drivingly connected to the above floor cleaning wand and the above floor cleaning wand is drivingly connected to a support member extending upwardly from the surface cleaning head; and, (g) a suction and filtration unit comprising the suction motor, the at least one cleaning stage, the above floor cleaning wand and the valve wherein the suction and filtration unit is removable from the surface cleaning apparatus.

33. The upright surface cleaning apparatus of claim 32 wherein the valve is provided in a housing to which the above floor-cleaning wand is secured.

34. The upright surface cleaning apparatus of claim 33 wherein the inlet end of the above floor-cleaning wand is secured to the housing.

35. The upright surface cleaning apparatus of claim 32 wherein the support member comprises an up flow duct mounted to the surface cleaning head and extending externally along the at least one cleaning stage to a position adjacent the inlet of the at least one cleaning stage.

36. The upright surface cleaning apparatus of claim 35 wherein the valve is mounted to the up flow duct.

37. An upright surface cleaning apparatus comprising:

a) a surface cleaning head having a dirty fluid inlet;

b) a fluid flow path extending from the dirty fluid inlet to a clean air outlet of the surface cleaning apparatus and including a suction motor and at least one cleaning stage;

c) an upright section mounted to the surface cleaning head and comprising at least one cleaning stage having an inlet;

d) an above floor cleaning wand connectable to the fluid flow path and having an inlet end;

e) a valve operable between a first position in which the surface cleaning head is in fluid flow communication with the at least one cleaning stage and a second position in which the above floor cleaning wand is in fluid flow communication with the at least one cleaning stage wherein the valve is positioned adjacent the inlet of the at least one cleaning stage;

f) a handle driving connected to the above floor cleaning wand and a further fluid flow path extending between the above floor cleaning wand and the at least one cleaning stage and the further fluid flow path comprises a hose; and, g) a suction and filtration unit comprising the suction motor and the at least one cleaning stage, wherein the suction and filtration unit is removable from the surface cleaning apparatus.

* * * * *